US010036282B2

(12) United States Patent
Cheng et al.

(10) Patent No.: US 10,036,282 B2
(45) Date of Patent: Jul. 31, 2018

(54) VANE SUPPORT SYSTEMS

(71) Applicant: UNITED TECHNOLOGIES CORPORATION, Farmington, CT (US)

(72) Inventors: Loi Cheng, South Windsor, CT (US); Raymond Surace, Newington, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 271 days.

(21) Appl. No.: 14/715,253

(22) Filed: May 18, 2015

(65) Prior Publication Data

US 2015/0345322 A1 Dec. 3, 2015

Related U.S. Application Data

(60) Provisional application No. 62/003,936, filed on May 28, 2014.

(51) Int. Cl.

| | |
|---|---|
| ***F01D 9/06*** | (2006.01) |
| ***F01D 17/16*** | (2006.01) |
| ***F01D 25/28*** | (2006.01) |
| ***F04D 29/56*** | (2006.01) |
| *F01D 9/02* | (2006.01) |
| *F01D 25/24* | (2006.01) |

(52) U.S. Cl.

CPC ..... *F01D 25/28* (2013.01); *F01D 17/162* (2013.01); *F04D 29/563* (2013.01); *F01D 9/02* (2013.01); *F01D 9/065* (2013.01); *F01D 25/24* (2013.01)

(58) Field of Classification Search

CPC ..... F01D 17/162; F01D 25/28; F01D 9/065; F01D 9/02; F01D 9/04; F01D 9/041; F01D 25/24; F04D 29/563

USPC ..... 415/150, 159–162, 142, 209.2, 209.3, 415/209.4, 210.1

See application file for complete search history.

(56) References Cited

U.S. PATENT DOCUMENTS

| | | | | |
|---|---|---|---|---|
| 3,558,237 A * | 1/1971 | Wall, Jr. | F01D 17/162 | 415/115 |
| 3,695,777 A * | 10/1972 | Westphal | F01D 17/162 | 415/147 |
| 4,135,362 A * | 1/1979 | Glenn | F02C 6/08 | 415/115 |
| 2012/0039710 A1* | 2/2012 | Mathieu | F01D 5/14 | 415/213.1 |

* cited by examiner

*Primary Examiner* — Christopher Verdier
(74) *Attorney, Agent, or Firm* — Cantor Colburn LLP

(57) ABSTRACT

A vane support system includes a frame and a vane. The frame has a first end configured to engage to a first platform and a second end configured to engage a second platform, so the frame can structurally support at least one of the first platform and the second platform. The first and second ends define a vane axis therebetween. The vane is mounted to the frame about the vane axis. A gas turbine engine includes a case defining a centerline axis of the engine, an inner housing and a plurality of variable vanes. The inner housing is radially inward of the case with respect to the centerline axis. At least one of the variable vanes structurally supports the case and the inner housing in response to at least one of radial, axial or tangential loads with respect to the centerline axis.

14 Claims, 4 Drawing Sheets

Fig. 3
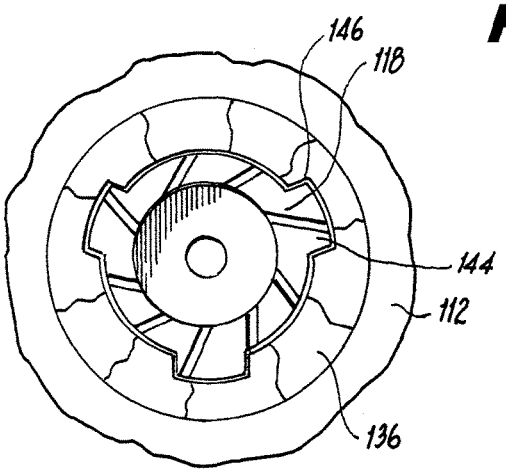
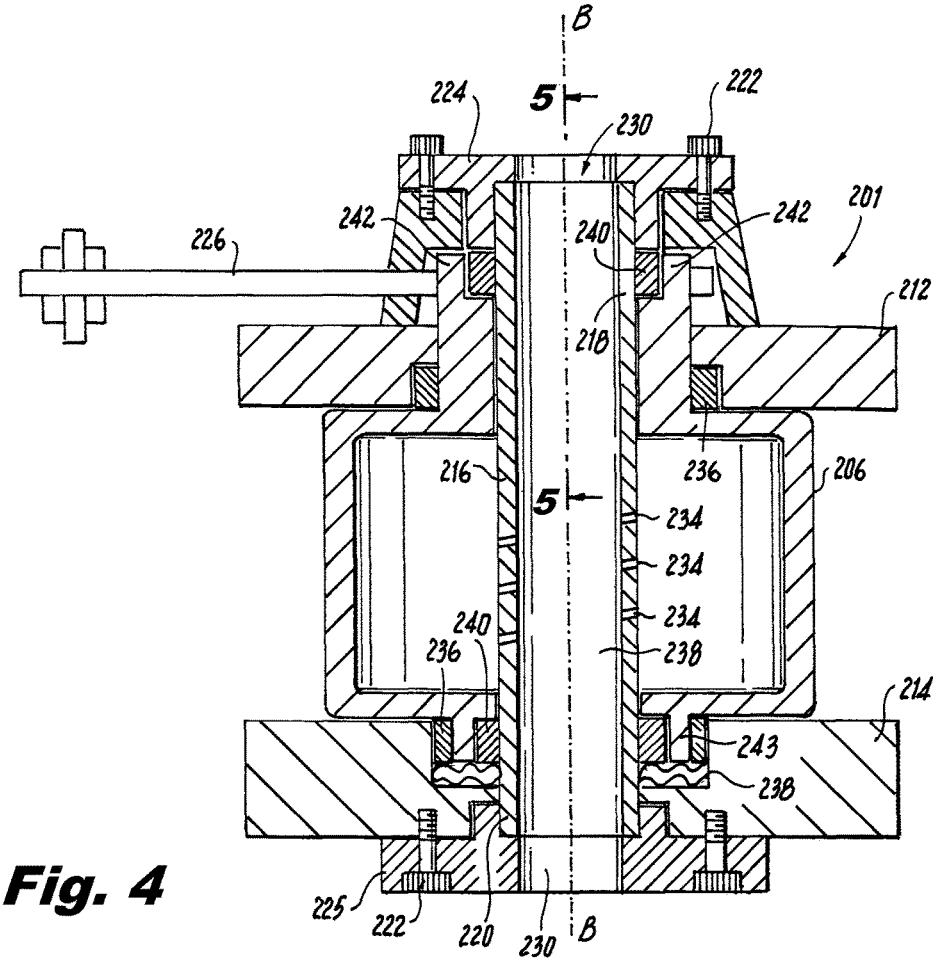
Fig. 4

VANE SUPPORT SYSTEMS

CROSS-REFERENCE TO RELATED APPLICATION

This application claims the benefit of priority under 35 U.S.C. § 119(e) to U.S. Provisional Application No. 62/003,936, filed May 28, 2014, which is incorporated herein by reference in its entirety.

STATEMENT REGARDING FEDERALLY SPONSORED RESEARCH OR DEVELOPMENT

This invention was made with government support under contract number N00014-09-D-0821-0006 awarded by the United States Navy. The government has certain rights in the invention.

BACKGROUND OF THE INVENTION

1. Field of the Invention

The present disclosure relates to vanes, such as variable vanes in gas turbine engines.

2. Description of Related Art

Traditionally, gas turbine engines can include multiple stages of vanes to condition and guide airflow through the compressor and/or turbine sections. The vane stages can include variable vanes configured to be pivoted about their respective vane axes to alter the angle of attack in order to optimize airflow characteristics for various operating conditions.

In traditional systems that include variable vanes, the airfoils of the variable vanes are cantilevered which precludes them from providing structure support. Instead, fixed stator vanes are used to provide structural support. For example, fixed stator vanes can be alternated circumferentially with the variable vanes.

Such conventional methods and systems have generally been considered satisfactory for their intended purpose. However, there is still a need in the art for improved vane systems. The present disclosure provides a solution for this need.

SUMMARY OF THE INVENTION

A vane support system includes a frame and a vane. The frame has a first end configured to engage a first platform and a second end configured to engage a second platform, so the frame can structurally support at least one of the first platform and the second platform. The first and second ends define a vane axis therebetween. The vane is mounted to the frame about the vane axis.

The vane support system can include at least one retaining member connected to the frame for securing the frame between the first and second platforms. The vane support system can also include a vane actuation component connected to the frame for driving rotation of the vane about the vane axis. The vane actuation component can be connected to the frame for driving rotation of the frame and the vane about the vane axis.

The frame can include a conduit for fluid communication with an air flow supply proximate to one of the ends of the frame. The frame can include cooling ports extending from the conduit for supplying cooling air from the airflow supply to the vane, e.g. to the interior of the vane. The frame can be cylindrical, and/or can include a notched portion proximate to one of the ends of the frame.

The vane support system can include a friction-modifying element connected to one of the ends of the frame. The friction-modifying element can be a bearing, a bushing, or the like. One of the ends of the frame can include an engagement member for mating with a corresponding engagement member on the friction-modifying element. The friction-modifying element can be defined radially outward from one of the ends of the frame, and/or from an end of the vane with respect to the vane axis. The vane support system can include a spring connected to the friction-modifying element to load the friction-modifying element toward the opposite end of the frame. The vane support system can include an additional friction-modifying element defined radially outward with respect to the vane axis between the frame and the vane.

A gas turbine engine includes a case defining a centerline axis of the engine, an inner housing and a plurality of variable vanes. The inner housing is radially inward of the case with respect to the centerline axis. At least one of the variable vanes structurally supports the case and the inner housing in response to at least one of radial, axial or tangential loads with respect to the centerline axis.

The gas turbine engine can include a gas path radially between the case and the inner housing. Each variable vane can be configured to rotate about its respective vane axis to adjust fluid flow through the gas path. The case can include discrete outer platforms corresponding to respective variable vanes. The inner housing can include discrete inner platforms corresponding to respective variable vanes.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 3 is a cross-sectional top plan view of a portion of an exemplary embodiment of the variable vane of FIG. 2, showing the projections of the frame mating with corresponding female features on the friction-modifying element;

FIG. 4 is a schematic cross-sectional side elevation view of another exemplary embodiment of variable vane constructed in accordance with the present disclosure, showing a frame configured to remain stationary while the variable vane rotates about a vane axis;

DETAILED DESCRIPTION OF THE PREFERRED EMBODIMENTS

Figure 1:
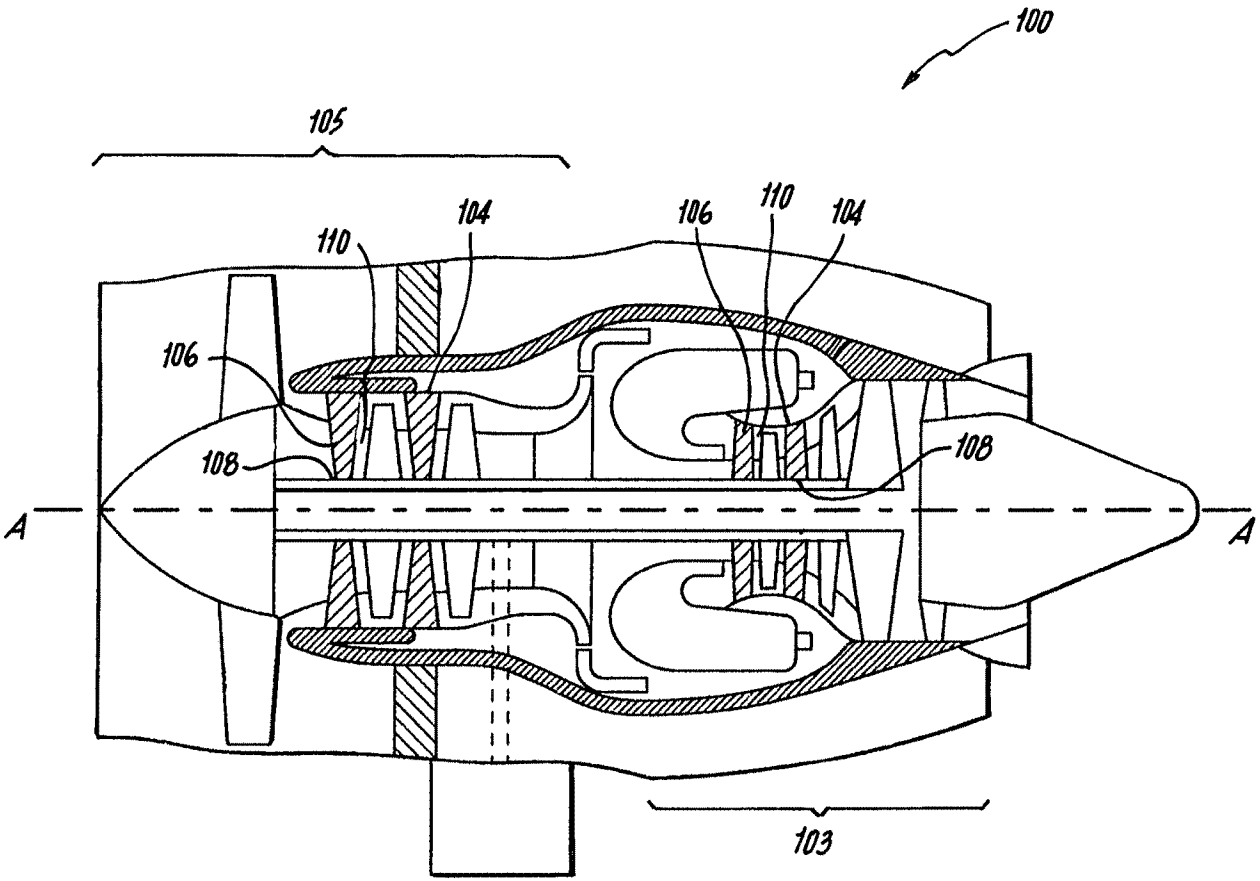
FIG. 1 is a schematic cross-sectional side elevation view of an exemplary embodiment of a gas turbine engine constructed in accordance with the present disclosure, showing a location of a variable vane system.

Reference will now be made to the drawings wherein like reference numerals identify similar structural features or aspects of the subject disclosure. For purposes of explanation and illustration, and not limitation, a cross-sectional view of an exemplary embodiment of the gas turbine engine 100 constructed in accordance with the disclosure is shown in FIG. 1 and is designated generally by reference character 100. Other embodiments of gas turbine engines constructed in accordance with the disclosure, or aspects thereof, are provided in FIGS. 2-5, as will be described.

As shown in FIG. 1, a gas turbine engine 100 includes a case 104 defining a centerline axis A, an inner housing 108, and a plurality of variable vanes 106. Variable vanes 106 are stator vanes and project radially inward from case 104. Variable vanes 106 are shown in a compressor section 105, but those skilled in the art will also readily appreciate that variable vanes 106 can also be disposed in a turbine section 103 of gas turbine engine 100, or can be used in any other suitable application. Inner housing 108 is radially inward of case 104 with respect to centerline axis A. Each variable vane 106 structurally supports case 104 and inner housing 108 in response to radial, axial and tangential loads with respect to centerline axis A. It is also contemplated that each variable vane 106 structurally supports its respective inner and outer platforms, described below with respect to FIG. 2, and any attachments, from similar loads.

Figure 2:
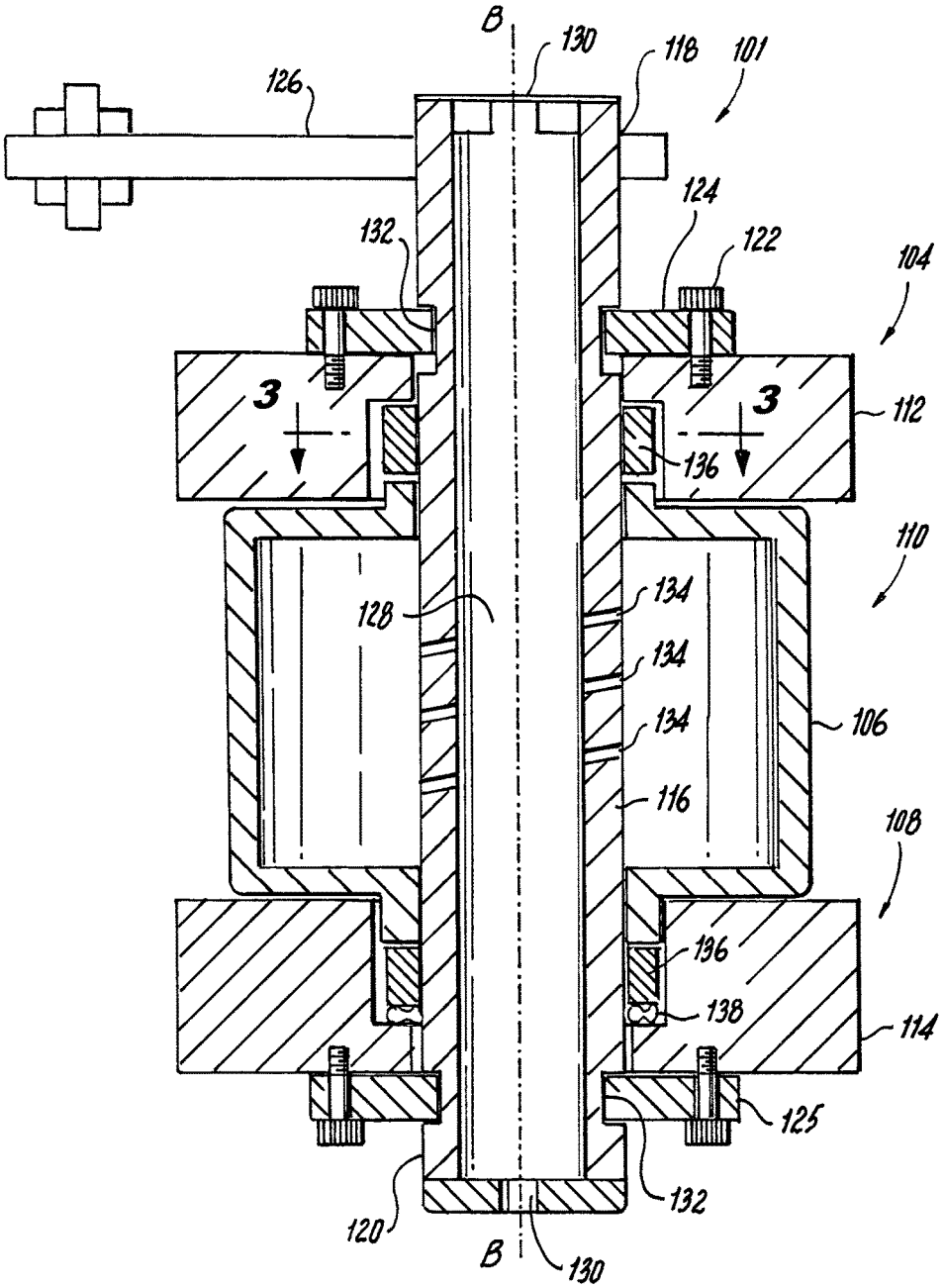
FIG. 2 is a schematic cross-sectional side elevation view of an exemplary embodiment of variable vane constructed in accordance with the present disclosure, showing a frame configured to rotate about a vane axis with the variable vane.

As shown in FIGS. 1 and 2, gas turbine engine 100 includes a fluid channel 110 between case 104 and inner housing 108. Each variable vane 106 is configured to rotate about a respective vane axis B to adjust fluid flow through fluid channel 110 as needed for given operating conditions. Case 104 and inner housing 108 include discrete outer platforms 112 and inner platforms 114, respectfully, corresponding to respective variable vanes 106.

Now with reference to FIG. 2, a vane support system 101 includes a frame 116 and a respective variable vane 106. Frame 116 includes first and second ends, 118 and 120, respectively. Frame 116 has a first end 118 operatively connected to a first platform, e.g. discrete outer platform 112, and a second end 120 operatively connected to a second platform, e.g. discrete inner platform 114. Frame 116 structurally supports outer platform 112 and inner platform 114 against radial, axial and tangential loads with respect to centerline axis A. First and second ends, 118 and 120, respectively, define a vane axis B therebetween. Variable vane 106 is mounted to frame 116 and is aligned with vane axis B.

Vane support system 101 includes retaining members 124 and 125 operatively connected to respective first and second ends, 118 and 120, respectively, of frame 116 for securing frame 116 between inner and outer platforms, 114 and 112, respectfully. Each retaining member 124 and 125 is connected to its respective platform with a mechanical fastener 122. It is contemplated that mechanical fastener 122 can be a variety of fasteners such as a bolt, rivet, pin, or the like, and/or any other suitable attachment can be used. It is also contemplated that retaining members 124 and 125 can have a variety of suitable shapes depending on the desired application. Vane support system 101 includes a vane actuation component 126 operatively connected to first end 118 of frame 116 for driving rotation of variable vane 106 and frame 116 about vane axis B relative to inner and outer platforms, 114 and 112, respectfully. It is contemplated that vane actuation component 126 can be connected to second end 120 of frame 116.

With continued reference to FIG. 2, frame 116 includes a conduit 128 that extends along vane axis B for fluid communication with air flow supply inlet 130 proximate to first and second ends, 118 and 120, respectively, of frame 116. Those skilled in the art will readily appreciate that airflow supply inlets 130 are not required on both first and second ends, 118 and 120, respectively, of frame 116. For example, it is contemplated that there can be one airflow supply inlet 130 on either first 118 or second end 120, or, if cooling is not required, there need be no airflow supply inlets 130 at all. Frame 116 includes cooling ports 134 extending from conduit 128 at an angle with respect to vane axis B for supplying cooling air from airflow supply inlet 130 to the interior of variable vane 106. Frame 116 is shown as a hollow cylinder, however, those skilled in the art will readily appreciate that frame 116 can have any suitable shape. Frame 116 includes notches 132 on first and second ends, 118 and 120, respectively, to accommodate respective corresponding retaining members 124 and 125. Those skilled in the art will readily appreciate that there are a variety of other geometries for effectively mating retaining members 124 and 125 with frame 116. For example, frame 116 can be tapered on either of first and second ends, 118 and 120, respectfully, or respective retaining members 124 and 125 can be mounted radially outward of first end 118 and radially inward of second end 120 with respect to centerline axis A, as will be described below.

Now with reference to FIGS. 2 and 3, vane support system 101 includes respective friction-modifying elements 136 operatively connected to respective first and second ends, 118 and 120, respectively, of frame 116. Friction-modifying elements 136 can be bearings, bushings, combinations thereof, or the like. Friction modifying elements 136 are configured to increase or reduce friction between their respective interfaces depending on the specific application. First end 118 of the frame 116 includes engagement members, for example, projections 144, for mating with corresponding engagement members, for example, female features 146, of its respective friction-modifying element 136. For example, to prevent relative rotation of frame 116 and an inner bearing face. Those skilled in the art will readily appreciate that second end 120 of frame 116 can also include projections 144 for mating with female features 146 of its respective friction-modifying element 136. While first end 118 of frame is shown herein as having three protrusions 144, any suitable number of protrusions can be used on first or second ends, 118 and 120, respectively. It is also contemplated that there are a variety of suitable engagement mechanisms for the interface between first and second ends 118 and 120, respectively, and their respective friction modifying elements 136. Alternatively, it is also contemplated that first end 118 and/or second end 120 can have smooth outer surfaces without projections, e.g. projections 144, and respective corresponding friction modifying elements 136 can have a smooth inner surface without female features, e.g. female features 146.

With continued reference to FIGS. 2 and 3, each friction-modifying element 136 is defined radially outward with respect to vane axis B from its respective first or second ends 118 and 120, respectively, of frame 116. Vane support system 101 includes a spring 138 operatively connected to friction-modifying element 136 to load friction-modifying elements 136 in a radially outboard direction, with respect to centerline axis A, toward first end 118 of frame 116. Alternatively vane support system 101 can include a spring, similar to spring 138, operatively connected radially between friction-modifying element 136 and outer platform 112, to load friction-modifying elements in a radially inboard direction, with respect to centerline axis A, toward second end 120 of frame 116.

As shown in FIG. 4, vane support system 201 includes a variable vane 206 and a frame 216 with first and second ends, 218 and 220, respectively, similar to variable vane 106 and frame 116, described above. Vane support system 201 includes a friction-modifying element 240 operatively connected radially between first end 218 of frame 216 and a first end 242 of variable vane 206 with respect to vane axis B. Another friction-modifying element 240 is operatively connected radially between second end 220 of frame 216 and a second end 243 of variable vane 206 with respect to vane axis B. First end 218 of frame 216 is connected to a first platform, e.g. discrete outer platform 212, and second end 220 of frame 216 is connected to a second platform, e.g. discrete inner platform 214. Frame 216 structurally supports a first platform, e.g. discrete outer platform 212, and a second platform, e.g. discrete inner platform 214. Variable vane 206 is mounted to frame 216 and is aligned with vane axis B for rotation about vane axis B relative to frame 216 and discrete outer and inner platforms, 212 and 214, respectively.

With continued reference to FIG. 4, vane support system 201 includes retaining members 224 and 225 operatively connected to respective first and second ends, 218 and 220, respectively, of frame 216 for securing frame 216 between discrete outer and inner platforms, 212 and 214, respectfully. Each of retaining members 224 and 225 are connected to their respective outer or inner platforms, 212 or 214, respectively, with screw thread interfaces to secure their respective first or second ends of the frame, 218 and 220, respectively. A retaining member 224 is mounted radially outward of first end 218 of frame 216 with respect to centerline axis A. Another respective retaining member 225 is mounted radially inward of second end 220 of frame 216 with respect to centerline axis A. Those skilled in the art will readily appreciate that there are a variety of other methods of operatively connecting retaining members 224 and 225 with frame 216. Each retaining member 224 and 225 is connected to its respective platform with a mechanical fastener 222, similar to mechanical fastener 122, described above. Vane support system 201 also includes airflow supply inlets 230 and cooling ports 234 similar to those described above with respect to vane support system 101.

Figure 5:
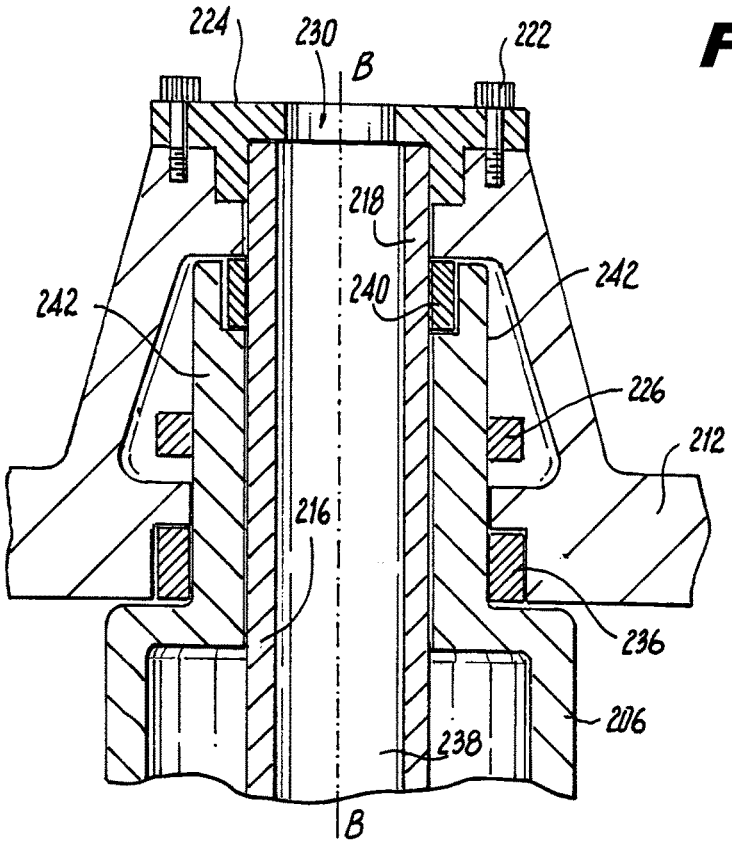
FIG. 5 is a cross-sectional side-elevation view of a portion of an exemplary embodiment of the variable vane of FIG. 4, showing an actuation component operatively connected to the variable vane.

As shown in FIGS. 4-5, vane support system 201 includes a vane actuation component 226 operatively connected to first end 242 of variable vane 206 for driving rotation of variable vane 206 about vane axis B relative to frame 216 and inner and outer platforms, 214 and 212, respectfully. Vane support system 201 varies from vane support system 101 in that frame 216 is stationary with respect to inner and outer platforms, 214 and 212, respectfully, while variable vane 206 rotates about frame 216. Vane support system 201 includes additional friction-modifying elements 236 disposed radially outward from variable vane 206 with respect to vane axis B. Respective friction-modifying elements 236 are operatively connected between first end 242 of variable vane 206 and outer platform 212, and between second end 243 of variable vane 206 and inner platform 214. It is contemplated that friction-modifying elements 236 can be bearings or bushings, similar to friction-modifying elements 136, described above. Vane support system 201 includes a spring 238 operatively connected to friction-modifying element 236 and inner platform 214 to radially load friction-modifying elements 236 in a radially outboard direction, with respect to centerline axis A, toward first end 218 of frame 216.

Figure 6:
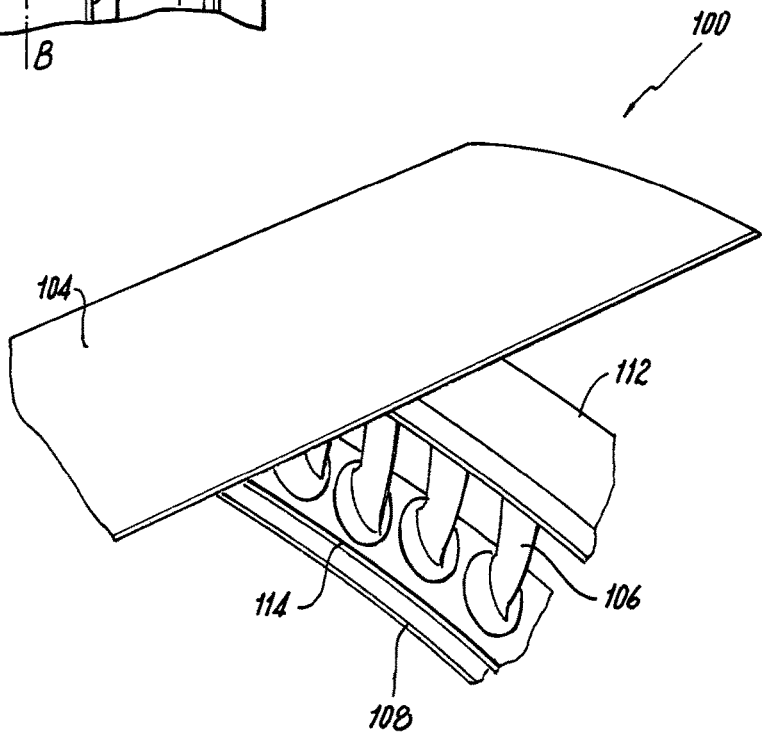
FIG. 6 is a perspective view of a portion of an exemplary embodiment of a gas turbine engine constructed in accordance with the present disclosure, showing a plurality of variable vane systems.

Those skilled in the art will readily appreciate that while vane support systems 101 and 201 are described above with respect to variable vanes 106 and 206 in the singular sense, it is contemplated that a plurality of variable vanes 106 and 206 and their respective support systems 101 and 201 can be disposed circumferentially around and between outer platforms 112 and 212 and inner platforms 114 and 214, as shown in FIG. 6. Further, it is also contemplated that outer platforms 112 and 212 can be separate and radially inward from case 104, also as shown in FIG. 6. Similarly, inner platforms 114 and 214 can be separate and radially outward from inner housing 108.

While described herein as discrete outer platforms 112 and 212 and inner platforms 114 and 214, those skilled in the art will readily appreciate that discrete outer platforms 112 and 212 and inner platforms 114 and 214 can be joined together to form respective inner and outer continuous cylinders. Or, in the alternative, instead of discrete platforms, outer platforms 112 and 212 and inner platforms 114 and 214 can be portions of respective inner and outer integral continuous cylinders. It is also contemplated that inner platforms 114 and 214 and outer platforms 112 and 212, can also be doublets, triplets, etc., e.g. inner and outer platforms, joined with other inner and outer platforms, respectively, to form a cylinder, where the inner and outer platforms include appropriate connection interfaces for more than one structural variable vane, e.g. vane 106 and 206. Those skilled in the art will readily appreciate that frames 116 and 216 reduce the need for non-variable structural support vanes as found within traditional vane stages. Instead of non-variable structural support vanes, frames 116 and 216, described above, provide the required structural support between inner housing 108 and case 104, while allowing all of variable vanes 106 and 206 in a particular stage to rotate about their respective vane axes, e.g. all of the vanes can be variable vanes and no non-variable vanes are present to support the inner housing 108 and case 104. It is contemplated that vane support systems 101 and 201 can also include a pre-determined failure position for variable vanes 106 and 206. For example, if vane actuation components 126 and 226 fail during operation, variable vanes 106 and 206 can be configured to stop in a pre-determined flow position, e.g. as determined by the location of the center of pressure of variable vanes 106 and 206 with respect to their respective vane axes B.

The methods and systems of the present disclosure, as described above and shown in the drawings, provide for gas turbine engines and vane support systems with superior properties including improved control over fluid flow properties through the engine. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A vane support system comprising:

a frame including a first end configured to engage a first platform and a second end configured to engage a second platform, the frame supporting at least one of the first platform and the second platform, wherein the first and second ends of the frame define a vane axis therebetween;

a vane mounted to the frame about the vane axis;

a first friction-modifying element disposed radially between the vane and the frame, relative to the vane axis; and a second friction-modifying element disposed radially between the vane and one or more of the first platform or the second platform;

wherein the frame is configured to be rotationally fixed about the vane axis relative to the first platform and the second platform; and wherein the vane is configured to rotate about the vane axis relative to the frame.

2. A vane support system as recited in claim 1, further comprising at least one retaining member connected to the frame for securing the frame to one of the first and second platforms.

3. A vane support system as recited in claim 1, further comprising a vane actuation component connected to the vane for driving rotation of the vane about the vane axis.

4. A vane support system as recited in claim 1, wherein the frame includes a conduit for fluid communication with an airflow supply proximate to one of the ends of the frame.

5. A vane support system as recited in claim 4, wherein the frame includes cooling ports extending from the conduit for supplying cooling air from the airflow supply to the vane.

6. A vane support system as recited in claim 1, wherein the frame is cylindrical.

7. A vane support system as recited in claim 1, wherein one or more of the first friction-modifying element or the second friction-modifying element is a bearing.

8. A vane support system as recited in claim 1, wherein one or more of the first friction-modifying element or the second friction-modifying element is a bushing.

9. A vane support system as recited in claim 1, wherein one of the ends of the frame includes an engagement member for mating with a corresponding engagement member on the first friction-modifying element.

10. A vane support system as recited in claim 1, further comprising a spring connected to the one or more of the first friction-modifying element or the second friction-modifying element to load the first friction-modifying element and/or the second friction-modifying element toward the opposite end of the frame.

11. A gas turbine engine, comprising:

a case defining a centerline axis of the gas turbine engine;

an inner housing radially inward of the case with respect to the centerline axis; and a plurality of variable vane assemblies, wherein at least one of the variable vane assemblies structurally supports the case and the inner housing in response to at least one of radial, axial or tangential loads with respect to the centerline axis, wherein the at least one of the variable vane assemblies includes:

a frame including a first end configured to engage a first platform and a second end configured to engage a second platform, the frame supporting at least one of the first platform and the second platform, wherein the first and second ends of the frame define a vane axis therebetween;

a vane mounted to the frame about the vane axis, the vane including a first vane end extending through the first platform;

a first friction-modifying element disposed radially between the vane and the frame, relative to the vane axis; and a second friction-modifying element disposed radially between the vane and one or more of the first platform or the second platform;

wherein the frame is configured to be rotationally fixed about the vane axis relative to the first platform and the second platform; and wherein the vane is configured to rotate about the vane axis relative to the frame.

12. A gas turbine engine as recited in claim 11, further comprising a fluid channel between the case and the inner housing, wherein each variable vane is configured to rotate about a respective vane axis to tune fluid flow through the fluid channel.

13. A gas turbine engine as recited in claim 11, wherein the case includes discrete outer platforms, wherein each discrete outer platform corresponds to at least one respective variable vane.

14. A gas turbine engine as recited in claim 11, wherein the inner housing includes discrete inner platforms, wherein each discrete inner platform corresponds to at least one respective variable vane.

* * * * *